US010272491B2

(12) United States Patent
Kobayashi et al.

(10) Patent No.: US 10,272,491 B2
(45) Date of Patent: Apr. 30, 2019

(54) SOFT MAGNETIC MEMBER AND MANUFACTURING METHOD OF SOFT MAGNETIC MEMBER

(71) Applicant: DENSO CORPORATION, Kariya-city, Aichi-pref. (JP)

(72) Inventors: Eiichi Kobayashi, Okazaki (JP); Kunihiro Kodama, Nagoya (JP); Masashi Totokawa, Nagoya (JP); Satoshi Takeuchi, Nagoya (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 141 days.

(21) Appl. No.: 14/534,706

(22) Filed: Nov. 6, 2014

(65) Prior Publication Data

US 2015/0129794 A1 May 14, 2015

(30) Foreign Application Priority Data

Nov. 12, 2013 (JP) ..... 2013-233676

(51) Int. Cl.
*H01F 41/02* (2006.01)
*B22F 1/02* (2006.01)
(Continued)

(52) U.S. Cl.
CPC ..... *B22F 1/02* (2013.01); *B22F 3/105* (2013.01); *B22F 3/1039* (2013.01); *H01F 1/33* (2013.01); *B22F 2003/1053* (2013.01)

(58) Field of Classification Search
None
See application file for complete search history.

(56) References Cited

U.S. PATENT DOCUMENTS 3,248,215 A * 4/1966 Bonis ..... B22F 3/14 219/632
5,134,260 A * 7/1992 Piehler ..... B22F 3/093 219/651
(Continued)

FOREIGN PATENT DOCUMENTS

JP 2006-351946 12/2003
JP 2006-080127 3/2006
(Continued)

OTHER PUBLICATIONS

Office Action dated Oct. 6, 2015 in corresponding Japanese Application No. 2013-233676.
(Continued)

*Primary Examiner* — Xiaowei Su
(74) *Attorney, Agent, or Firm* — Harness, Dickey & Pierce, P.L.C.

(57) ABSTRACT

In a manufacturing method of a soft magnetic member, a material powder that includes ferrous particles and an organic layer formed on a surface of each of the ferrous particles is prepared. The organic layer contains at least one element selected from the group consisting of Si, Mg, Ti, and V. The material powder is compacted to form a green compact, and the green compact is induction-heated with a frequency of 100 kHz or higher to form an insulation layer made of an oxide containing the element on the surface of each of the ferrous particles.

5 Claims, 2 Drawing Sheets

(51) Int. Cl.

| | |
|---|---|
| ***B22F 3/10*** | (2006.01) |
| ***H01F 1/33*** | (2006.01) |
| ***B22F 3/105*** | (2006.01) |

(56) References Cited

U.S. PATENT DOCUMENTS

| | | | | |
|---|---|---|---|---|
| 2011/0284794 | A1 | 11/2011 | Sugiyama et al. | |
| 2012/0286909 | A1* | 11/2012 | Ohwaki | H01F 1/24<br>335/297 |
| 2013/0056674 | A1* | 3/2013 | Inagaki | B22F 1/007<br>252/62.55 |
| 2014/0232507 | A1* | 8/2014 | Nishio | B22F 1/02<br>336/233 |

FOREIGN PATENT DOCUMENTS

| | | | | |
|---|---|---|---|---|
| JP | 2008-277775 | | 11/2008 | |
| JP | 2009-016701 | | 1/2009 | |
| JP | 2013-149659 | | 8/2013 | |
| WO | WO2011/108072 | | 9/2011 | |
| WO | WO 2011126119 | A1 * | 10/2011 | B22F 1/007 |
| WO | WO 2013051229 | A1 * | 4/2013 | B22F 1/02 |

OTHER PUBLICATIONS

Office Action dated Feb. 16, 2016 issued in the corresponding JP application No. 2013-233676 in Japanese with English translation.

* cited by examiner

SOFT MAGNETIC MEMBER AND MANUFACTURING METHOD OF SOFT MAGNETIC MEMBER

CROSS REFERENCE TO RELATED APPLICATIONS

The present application is based on and claims priority to Japanese Patent Application No. 2013-233676 filed on Nov. 12, 2013, the contents of which are incorporated in their entirety herein by reference.

TECHNICAL FIELD

The present disclosure relates to a soft magnetic member and a manufacturing method of a soft magnetic member.

BACKGROUND

As a conventional manufacturing method of a soft magnetic member used as a material of a core in a motor or a reactor, for example, a method of compacting a material powder, in which an insulation layer of Ni or the like is formed on a surface of each of ferrous particles, is known.

JP-A-2009-16701 discloses a manufacturing method of a soft magnetic member in which a soft magnetic member that includes an insulation layer including an organic component instead of an insulation layer of Ni or the like is annealed at a temperature within a range from 550° C. to 850° C.

However, the conventional manufacturing method of the soft magnetic member has following issues. Namely, in the above-described manufacturing method of the soft magnetic member, the material powder, in which the insulation layer of Ni or the like is formed on the surface of each of the ferrous particles, is compacted. Because of a high pressure applied to the material powder at compacting, the insulation layer may be damaged, and the adjacent ferrous particles may be conducted. Thus, a specific resistance of the obtained soft magnetic member may decrease, and thereby an eddy loss may increase.

SUMMARY

It is an object of the present disclosure to provide a soft magnetic member having a high specific resistance.

In a manufacturing method of a soft magnetic member according to one aspect of the present disclosure, a material powder that includes ferrous particles and an organic layer formed on a surface of each of the ferrous particles is prepared. The organic layer contains at least one element selected from the group consisting of silicon (Si), magnesium (Mg), titanium (Ti), and vanadium (V). The material powder is compacted to form a green compact. The green compact is induction-heated with a frequency of 100 kHz or higher to form an insulation layer made of an oxide containing the element on the surface of each of the ferrous particles.

In the above-described manufacturing method of the soft magnetic member, the insulation layer is formed by induction-heating the green compact with the frequency of 100 kHz or higher. Due to a skin effect by the induction heating with a high frequency, the surface of each of the ferrous particles in the green compact can be partially heated. As a result, the insulation layer made of the oxide containing the element can be formed on the surface of each of the ferrous particles while restricting a diffusion of the element to each of the ferrous particles. In the above-described manufacturing method, the insulation layer is formed after forming the green compact. Thus, the above-described manufacturing method can prevent issues that the insulation layer is damaged by a high pressure applied to the material powder at compacting, and the adjacent ferrous particles are conducted, which may be caused by the conventional manufacturing method. Accordingly, the soft magnetic member having a high specific resistance can be manufactured.

A soft magnetic member according to another aspect of the present disclosure includes soft magnetic particles including ferrous particles and an insulation layer formed on a surface of each of the ferrous particles. The insulation layer is made of an oxide containing at least one element selected from the group consisting of Si, Mg, Ti and V. The soft magnetic member has a density within a range from 7 g/cm$^3$ to a density of Fe and has a specific resistance of $1\times10^3$ μΩ·m or higher.

The above-described soft magnetic member can be manufactured by the above-described manufacturing method of the soft magnetic member. Thus, the above-described soft magnetic member can have a high specific resistance and can reduce an eddy loss.

BRIEF DESCRIPTION OF THE DRAWINGS

Additional objects and advantages of the present disclosure will be more readily apparent from the following detailed description when taken together with the accompanying drawings. In the drawings.

DETAILED DESCRIPTION

Figure 1:
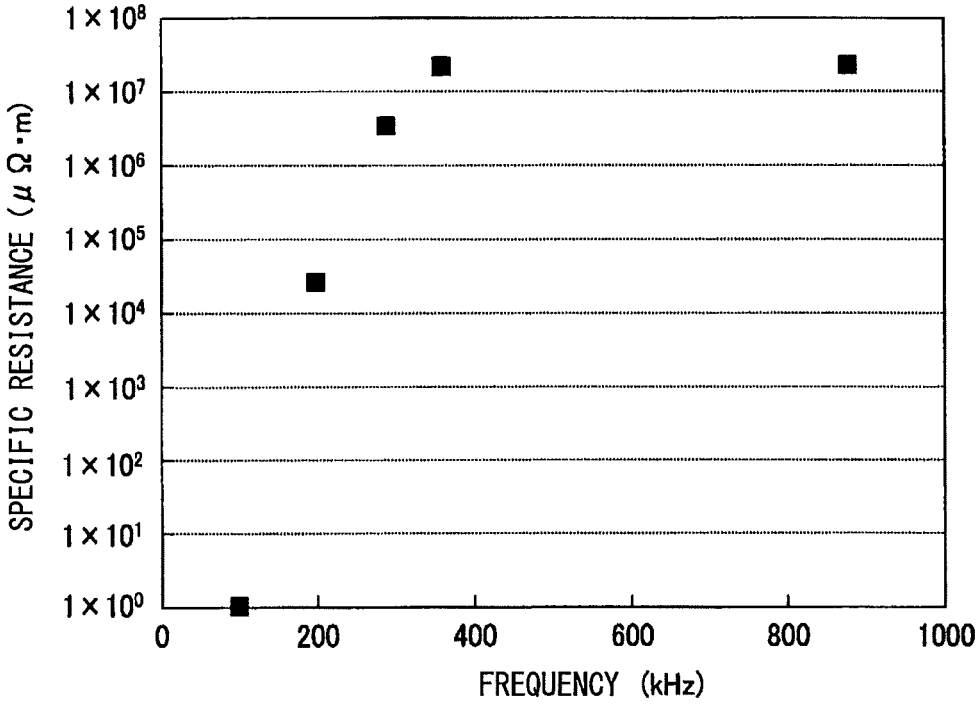
FIG. 1 is a graph showing a relationship between a frequency at an induction heating and a specific resistance of a soft magnetic member.

Before describing embodiments of the present disclosure, various aspects of the present disclosure will be described.

In a manufacturing method of a soft magnetic member according to one aspect of the present disclosure, a material powder that includes ferrous particles and an organic layer formed on a surface of each of the ferrous particles is prepared. The organic layer contains at least one element selected from the group consisting of silicon (Si), magnesium (Mg), titanium (Ti), and vanadium (V). The material powder is compacted to form a green compact. The green compact is induction-heated with a frequency of 100 kHz or higher to form an insulation layer made of an oxide containing the element on the surface of each of the ferrous particles.

As the ferrous particles, for example, pure iron particles or Fe-based alloy particles can be used. As the organic layer containing the elements, for example, an organic compound containing the element can be used. Specifically, a Si organic compound such as silicone resin, a Mg-containing organic compound such as magnesium acetate, a Ti-containing organic compound such as titanium octyleneglycolate, or a V-containing organic compound such as vanadium alkoxide can be used. As the element, from the point of view of universal use, Si or Mg can be appropriately used. The material powder can be prepared, for example, after dissolving or diffusing the organic compound containing the element into an appropriate solvent, the solution is sprayed and mixed to a powder of ferrous particles. An average particle diameter of the ferrous particles may be about 50 to 100 μm from the point of view of a magnetic property and a productivity. The average particle diameter is a particle diameter d50 when a volume-based cumulative frequency distribution measured by a laser diffraction/scattering method is 50%.

A pressure at the compacting to form the green compact may be about 400 to 1300 MPa, preferably about 1200 to 1300 MPa. A density of the green compact may be about 7.0 to 7.7 g/cm$^3$, preferably about 7.3 to 7.7 g/cm$^3$, more preferably about 7.6 to 7.7 g/cm$^3$. The green compact formed by the compacting can have a configuration in which the organic layer containing the element is interposed between the ferrous particles. The green compact can be formed using a metal mold.

The frequency at the induction heating to form the insulation layer may be 100 kHz or higher, preferably 150 kHz or higher, more preferably 200 kHz or higher, further preferably 400 kHz or higher from the point of view that the specific resistance of the soft magnetic member is more likely to be high. On the other hand, the frequency at the induction heating may be 900 kHz or lower from the point of view that an improving effect of the specific resistance tends to be saturated, and a power source is downsized.

In the process of forming the insulation layer, a highest temperature of heating is within a temperature range that enables an oxidation of the element. The temperature range that enables oxidation of the element can be determined using a Si—$O_2$ phase diagram, a Mg—$O_2$ phase diagram, a Ti—$O_2$ phase diagram, or a V—$O_2$ phase diagram. However, the highest temperature of heating is set to be lower than 1538° C. that is a melting point of iron. An atmosphere in the above-described temperature range may be air atmosphere. When the element is Si, the highest temperature of heating may be within a range from 800° C. to 1400° C.

In the present case, the insulation layer made of the oxide containing the element can be formed with certainty. In addition, there is an advantage that the element can be oxidized in air atmosphere.

The highest temperature of heating may be preferably 850° C. or higher, more preferably 875° C. or higher, further preferably 900° C. or higher from the point of view that the insulation layer made of the oxide containing the element can be formed with certainty, and the oxidation can be achieved in air atmosphere. The highest temperature of heating may be preferably 1300° C. or lower, more preferably 1200° C. or lower, further preferably 1100° C. or lower. The induction heating may be stopped at the highest temperature and the temperature may be maintained for about 5 to 300 seconds from the point of view of uniformly heating.

In the process of forming the insulation layer, a temperature increasing rate within a heating temperature range of 500° C. or lower may be 210° C./sec or lower.

In a case where gas generated by thermal decomposition at heating or staying gas in the green compact are difficult to pass to the outside and the soft magnetic member includes a lot of inner pores due to remaining gas, if an operating temperature of the soft magnetic member is higher, the inner pores are buried due to expansion of ferrous particles, and the ferrous particles become easily conduct. Thus, from the point of view of reducing the eddy loss, the inner pores are not favorable. However, in the above-described case, the temperature increasing temperature within the heating temperature range of 500° C. or lower is 210° C./sec or lower. Thus, a rapid temperature increase can be restricted, the gas generated by the thermal decomposition and the staying gas can pass to the outside more easily, and the soft magnetic member with less inner pores due to the remaining gas can be obtained. Thus, the present case has an advantage for improving the specific resistance of the soft magnetic member and reducing the eddy loss.

The temperature increasing rate may be preferably 175° C./sec or lower, more preferably 150° C./sec or lower, further preferably 125° C./sec or lower from the point of view of increasing the above-described effect. A lower limit of the temperature increasing rate may be preferably 10° C./sec or higher, more preferably 20° C./sec or higher, further preferably 30° C./sec or higher. When the insulation layer is formed, a heating start temperature may be about room temperature (25° C.). The temperature increasing rate may be set in the above-described range within a heating temperature range of preferably 475° C. or lower, more preferably 450° C. or lower, further preferably 425° C. or lower, further more preferably 400° C. or lower from the point of view of increasing the specific resistance while restricting the inner pores due to the remaining gas.

In the process of forming the insulation layer, a pressure in a heating atmosphere within the heating temperature range of 500° C. or lower may be atmospheric pressure or lower.

When the pressure in the heating atmosphere is reduced to be atmospheric pressure or lower, the gas generated by the thermal decomposition of the organic layer at heating and the staying gas in the green compact pass to the outside more easily. Thus, also in the present case, the soft magnetic member with less inner pores due to the remaining gas can be obtained, and there is an advantage for improving the specific resistance of the soft magnetic member and reducing the eddy loss.

The pressure in the heating atmosphere may be preferably 90 kPa abs or lower, more preferably 80 kPa abs or lower, further preferably 70 kPa abs or lower, further more preferably 60 kPa abs or lower from the point of view of increasing the above-described effect. A lower limit of the pressure in the heating atmosphere may be preferably 5 kPa abs or higher, more preferably 10 kPa abs or higher from the point of view of miniaturization of a facility. The pressure in the heating atmosphere may be set to the above-described range within a heating temperature range of preferably 475° C. or lower, more preferably 450° C. or lower, further preferably 425° C. or lower, further more preferably 400° C. or lower from the point of view of increasing the specific resistance while restricting the inner pores due to the remaining gas.

In the process of forming the insulation layer, the green compact may be maintained in a pressurized state.

In a case where the green compact is maintained in the pressurized state, the gas generated by the thermal decomposition of the organic layer at heating and the staying gas in the green compact can pass to the outside more easily. Thus, also in the present case, the soft magnetic member with less inner pores due to the remaining gas can be obtained, and there is an advantage for improving the specific resistance of the soft magnetic member and reducing the eddy loss.

As a method of maintaining the green compact in the pressurized state, for example, after the process of forming the green compact, the manufacturing process may proceed to the process of forming the insulation layer while maintaining a pressurized state with a pressure equal to or lower than a pressure at compacting, preferably with the pressure at compacting. Alternatively, the pressurized state at the process of forming the green compact may be once released, and then the process of forming the insulation layer may be performed while maintaining the green compact in a pressurized state with the pressure equal to or lower than the pressure at compacting, preferably with the pressure at compacting. Especially in the former method, a continuity from the process of forming the green compact to the process of forming the insulation layer can be fine. Thus, the productivity can be improved.

The pressurized state may be maintained for a part of heating in the process of forming the insulation layer or the whole of heating in the process of forming the insulation layer. The pressurized state may be maintained with a heating temperature range of 500° C. or lower, preferably 475° C. or lower, more preferably 450° C. or lower, further preferably 425° C. or lower, further more preferably 400° C. or lower. Because the gas is easily generated by the thermal decomposition of the organic layer within the above-described heating temperature range, a degassing promotion effect by maintaining the pressurized state can be large.

In the process of forming the insulation layer, the induction heating may be performed one or more times. For example, after an induction heating is performed on one induction heating condition from the heating start temperature to a heating middle temperature (the heating start temperature<the heating middle temperature<the highest temperature), additional induction heating may be performed to the highest temperature on the same or different induction heating condition without cooling the green compact. Alternatively, after an induction heating is performed on one induction heating condition from the heating start temperature to the heating middle temperature, the green compact may be once cooled, then additional induction heating may be performed from an after-cooling temperature to the highest temperature on the same or different induction heating condition. The former method has an advantage for saving energy and for improving productivity. The later method has an advantage that a condition of a heating atmosphere can be easily changed.

A soft magnetic member according to another aspect of the present disclosure includes soft magnetic particles including ferrous particles and an insulation layer formed on a surface of each of the ferrous particles. The insulation layer includes an oxide containing at least one element selected from the group consisting of Si, Mg, Ti and V. The soft magnetic member has a density within a range from 7 g/cm$^3$ to a density of Fe and has a specific resistance of $1\times10^3$ μΩ·m or higher.

The above-described soft magnetic member can be manufactured, for example, by the above-described manufacturing method of the soft magnetic member. The above-described soft magnetic member can have a high specific resistance and can reduce an eddy loss.

The density of the soft magnetic member may be preferably 7.4 g/cm$^3$ or higher, more preferably 7.6 g/cm$^3$ or higher, further preferably 7.7 g/cm$^3$ or higher from the point of view of flux density or the like. The above-described density is a value measured by the Archimedes' method. The density of Fe is a value at a room temperature.

A specific resistance of the soft magnetic member may be preferably $1\times10^6$ μΩ·m or higher, more preferably $1\times10^7$ μΩ·m or higher, further preferably $1\times10^8$ μΩ·m or higher from the point of view of high insulation or the like. In addition, the specific resistance of the soft magnetic member may be preferably $1\times10^6$ μΩ·m or lower from the point of view of decreasing a flux density. The specific resistance can be calculated by installing electric wires on both end surfaces of a column-shaped sample and applying a constant voltage.

In the soft magnetic member, a thickness of the insulation layer may be 40 nm or greater.

When the thickness of the insulation layer is 40 nm or greater, the specific resistance can be improved with certainty. A preferable lower limit 40 nm of the insulation layer corresponds to a thickness when the density is 7.8 g/cm$^3$ (the highest using region of the soft magnetic member) at a void content 0% (ideal state) in a case where an average particle diameter of the ferrous particles is 100 μm (uniform). The thickness of the insulation layer may be preferably 50 nm or greater, more preferably 60 nm or greater, further preferably 70 nm or greater, further more preferably 80 nm or greater from the point of view of high insulation. In addition, the thickness of the insulation layer may be preferably 566 nm or smaller, more preferably 500 nm or smaller, further preferably 400 nm or smaller, further more preferably 300 nm or smaller from the point of view of reducing the flux density. A preferable upper limit 566 nm of the insulation layer corresponds to a thickness when the density is 7.0 g/cm$^3$ (the lowest using region of the soft magnetic member) at a void content 0% (ideal state) in a case where an average particle diameter of the ferrous particles is 100 μm (uniform). The thickness of the insulation layer may be measure by an observation with a transmission electron microscope (TEM) or a component identification by an energy-dispersive X-ray spectroscopy (EDS) analysis.

In the soft magnetic member, the average particle diameter of the ferrous particles may be preferably 80 μm or greater, more preferably 90 μm or greater, further preferably 100 μm or greater from the point of view of magnetic property or the like. The average particle diameter of the ferrous particles may be preferably 150 μm or smaller, more preferably 140 μm or smaller, further preferably 130 μm or smaller from the point of view of productivity or the like. The average particle diameter of the ferrous particles is an average value of particle diameters of the ferrous particles measured with the observation with the TEM.

The soft magnetic member may be suitably used, for example, as a core material in a motor, a reactor, or an electromagnetic actuator.

Each of the above-described configurations may be optionally combined as necessary to obtain the above-described effects.

Soft magnetic members and manufacturing methods of soft magnetic members according to embodiments of the present disclosure will be described below.

First Embodiment

In a manufacturing method of a soft magnetic member according to a first embodiment of the present disclosure, a material powder that includes ferrous particles and an organic layer formed on a surface of each of the ferrous particles is prepared. The organic layer contains at least one element selected from a group consisting of Si, Mg, Ti and V. The material powder is compacted to form a green compact. The green compact is induction-heated with a frequency of 100 kHz or higher to form an insulation layer made of an oxide containing the element on the surface of each of the ferrous particles. Details will be described below.

In a process of preparing the material powder, a solution in which a Si-containing organic compound for forming the organic layer is dissolved in an organic solvent is sprayed and mixed to a powder of ferrous particles and the organic solvent is vaporized, thereby forming the material powder.

In a process of forming the green compact, the material powder is filled in a metal mold with which a predetermined shape is moldable and is compacted with a pressure of 400 to 1300 MPa, thereby forming the green compact.

In a process of forming the insulation layer, the green compact is induction-heated with the frequency of 100 kHz or higher in such a manner that the highest temperature of heating is within a range from 800° C. to 1400° C. to form the insulation layer. In the present embodiment, after the green compact is formed, a manufacturing process proceeds to the process of forming the insulation layer while maintaining the pressurized state with the pressure at compacting. Then, the green compact is induction-heated in the metal mold. After the highest temperature is maintained for 5 to 300 seconds, the green compact is naturally cooled.

In the induction heating, a temperature increasing rate within a heating temperature range of 500° C. or lower is set to be 210° C./sec or lower. In addition, a pressure in a heating atmosphere within the heating temperature range of 500° C. or lower is set to be atmospheric pressure or lower. Furthermore, the green compact is maintained in a pressurized state within the heating temperature range of 500° C. or lower.

In the present embodiment, as described above, the soft magnetic member is manufactured by oxidizing the organic layer containing the element on the surface of each of the ferrous particles and forming the insulation layer made of a Si oxide as the oxide containing the element.

Next, effects of the manufacturing method of the soft magnetic member according to the present embodiment will be described.

The manufacturing method of the soft magnetic member according to the present embodiment includes the above-described processes. Especially, in the process of forming the insulation layer, the green compact is induction-heated with the frequency of 100 kHz or higher. Thus, the manufacturing method according to the present embodiment can partially heat the surface of each of the ferrous particles in the green compact due to a skin effect of the induction heating with a high frequency. As a result, the insulation layer made of the oxide containing the element can be formed on the surface of each of the ferrous particles while restricting a diffusion of the element to each of the ferrous particles. In the manufacturing method of the soft magnetic member according to the present embodiment, the insulation layer is formed after forming the green compact. Thus, the manufacturing method of the soft magnetic member according to the present embodiment can prevent issues that the insulation layer is damaged by a high pressure applied to the material powder at compacting, and the adjacent ferrous particles are conducted, which may be caused by the conventional manufacturing method. Accordingly, the soft magnetic member having a high specific resistance can be manufactured.

In the manufacturing method of the soft magnetic member according to the present embodiment, the highest temperature in the process of forming the insulation layer is within the range from 800° C. to 1400° C. Thus, the insulation layer made of the oxide containing the element can be formed with certainty. In addition, there is an advantage that the element can be oxidized in air atmosphere.

In addition, in the process of forming the insulation layer, the temperature increasing rate within the heating temperature range of 500° C. or lower is set to be 210° C./sec or lower. Thus, a rapid temperature increase can be avoided, gas generated by thermal decomposition at heating or staying gas in the green compact can easily pass to the outside, and the soft magnetic member with less inner pores due to remaining gas can be obtained. Therefore, the manufacturing method of the soft magnetic member according to the present embodiment can improve the specific resistance of the soft magnetic member and can reduce the eddy loss.

In addition, in the process of forming the insulation layer, the pressure in the heating atmosphere within the heating temperature range of 500° C. or lower is set to be atmospheric pressure or lower. Thus, by reducing the pressure in the heating atmosphere, the gas generated by the thermal decomposition at heating and the staying gas in the green compact can pass to the outside more easily, and the soft magnetic member with less inner pores due to remaining gas can be obtained. Therefore, the manufacturing method of the soft magnetic member according to the present embodiment can improve the specific resistance of the soft magnetic member and can reduce the eddy loss.

Furthermore, in the process of forming the insulation layer, the green compact is maintained in the pressurized state. Thus, by pressurization, the gas generated by the thermal decomposition at heating and the staying gas in the green compact can pass to the outside more easily, and the soft magnetic member with less inner pores due to remaining gas can be obtained. Therefore, the manufacturing method of the soft magnetic member according to the present embodiment can improve the specific resistance of the soft magnetic member and can reduce the eddy loss. In addition, because the manufacturing process proceeds from the process of forming the green compact to the process of forming the insulation layer while maintaining the pressurized state at forming the green compact, a continuity from the process of forming the green compact to the process of forming the insulation layer can be fine. Thus, the manufacturing method of the soft magnetic member according to the present embodiment can improve the productivity.

Second Embodiment

A soft magnetic member according to a second embodiment of the present disclosure includes soft magnetic particles including ferrous particles and an insulation layer formed on a surface of each of the ferrous particles. The insulation layer includes an oxide that containing at least one element selected from a group consisting of Si, Mg, Ti and V. The soft magnetic member has a density within a range from 7 g/cm$^3$ to a density of Fe and has a specific resistance of $1\times10^3$ μΩ·m or higher.

The soft magnetic member according to the present embodiment can be manufactured by the manufacturing method according to the first embodiment, and the oxide containing the element is, for example, $SiO_2$, which is Si oxide.

Because the soft magnetic member according to the present embodiment has the above-described structure, the soft magnetic member can have a high specific resistance and can reduce an eddy loss.

More details will be described below using experimental examples.

Example 1

After 4.51 g of silicone resin ("KR-220L" manufactured by Shin-Etsu Chemical Co., Ltd.) is dissolved in 343 g of isopropyl alcohol solution, the solution is sprayed and mixed to 1500 g of a powder of ferrous particles (pure iron powder having an average diameter of 750 μm: "ABC100.30" manufactured by Höganäs Japan) at a rate of 6.0 g/min. After that, the isopropyl alcohol is vaporized, and the ferrous particles are maintained at 225° C. for 1 hour so that interfaces between the ferrous particles and the silicone resin are become attached. Accordingly, the material powder is prepared.

Next, the material powder is filled in a metal mold with which a cylindrical shape is moldable, and the material powder is compacted with a pressure of 1500 MPa in air atmosphere to obtain a green compact having a density of 7.60 g/cm$^3$.

Then, the green compact is induction-heated as follows. Specifically, the green compact is induction-heated from the room temperature to 400° C. under the condition that a frequency is 400 kHz, a temperature increasing rate is 200° C./sec, and a pressure in a heating atmosphere is 14 Pa abs. After the green compact is held at 400° C. for 30 sec, the green compact is naturally cooled. After that, the green compact is induction-heated from the room temperature to 1000° C. under the condition that a frequency is 400 kHz, a temperature increasing rate is 200° C./sec, and a pressure in a heating atmosphere is atmospheric pressure. The highest temperature in the induction heating is 1000° C. In the present example, after the green compact is formed, the green compact is removed from the metal mold, and the induction heating is performed without maintaining the green compact in a pressurized state. Accordingly, a sample 1 of soft magnetic member is obtained.

The sample 1 is subjected to a TEM observation and an EDS analysis. As a result, it is confirmed that, in the sample 1, the insulation layer made of $SiO_2$ is formed on the surface of each of the ferrous particles. Thus, it is confirmed that the sample 1 includes soft magnetic particles that include the ferrous particles and the insulation layer formed on the surface of each of the ferrous particles. A thickness of the insulation layer is 40 to 50 nm. In addition, as a result of measuring a density and a specific resistance of the sample 1, the density is 7.55 g/cm$^3$ and the specific resistance is $6.1\times10^7$ μΩ·m.

Example 2

A material powder is prepared in a manner similar to the example 1.

Next, a green compact having a density of 7.60 g/cm$^3$ is obtained in a manner similar to the example 1.

Then, the green compact is induction-heated as follows. Specifically, the green compact is induction-heated from the room temperature to 400° C. under the condition that a frequency is 400 kHz, a temperature increasing rate is 50° C./sec, and a pressure in a heating atmosphere is atmospheric pressure. After that, without cooling naturally, the green compact is induction heated from 400° C. to 1000° C. under the condition that a frequency is 400 kHz, a temperature increasing rate is 200° C./sec, and a pressure in a heating atmosphere is atmospheric pressure. After the green compact is held at 1000° C. for 60 seconds, the green compact is naturally cooled. The highest temperature in the induction heating is 1000° C. In the present example, after the green compact is formed, the green compact is removed from the metal mold, and the induction heating is performed without maintaining the green compact in a pressurized state. Accordingly, a sample 2 of soft magnetic member is obtained.

The sample 2 is subject to observation and measurement in a manner similar to the example 1. As a result, it is confirmed that the sample 2 has a microstructure similar to the sample 1. A thickness of the insulation layer is 40 to 50 nm, a density is 7.58 g/cm$^3$, and a specific resistance is $4.1\times10^7$ μΩ·m.

Example 3

Multiple samples of soft magnetic member are formed by a method similar to the example 2 except that a temperature increasing rate within a heating temperature range from the room temperature to 400° C. is 210° C./sec, a temperature increasing rate within a heating temperature range from 400° C. to 1000° C. is 210° C./sec, and a frequency in the induction heating is changed. Then, a specific resistance of each of the samples is measured, and a relationship between the frequency in the induction heating and the specific resistance of the soft magnetic member is obtained.

As shown in FIG. 1, when the frequency of the induction heating is set to be 100 kHz or higher, the specific resistance of the soft magnetic member increases with increase of the frequency. However, when the frequency of the induction heating is excessively increased, an improving effect of the specific resistance tends to be saturated.

Example 4

Multiple samples of soft magnetic member are formed by a method similar to the example 2 except that a temperature increasing rate within a heating temperature range from the room temperature to 400° C. is changed. Then, a specific resistance of each of the samples is measured, and a relationship between the temperature increasing rate within the heating temperature range from the room temperature to 400° C. and the specific resistance of the soft magnetic member is obtained.

Figure 2:
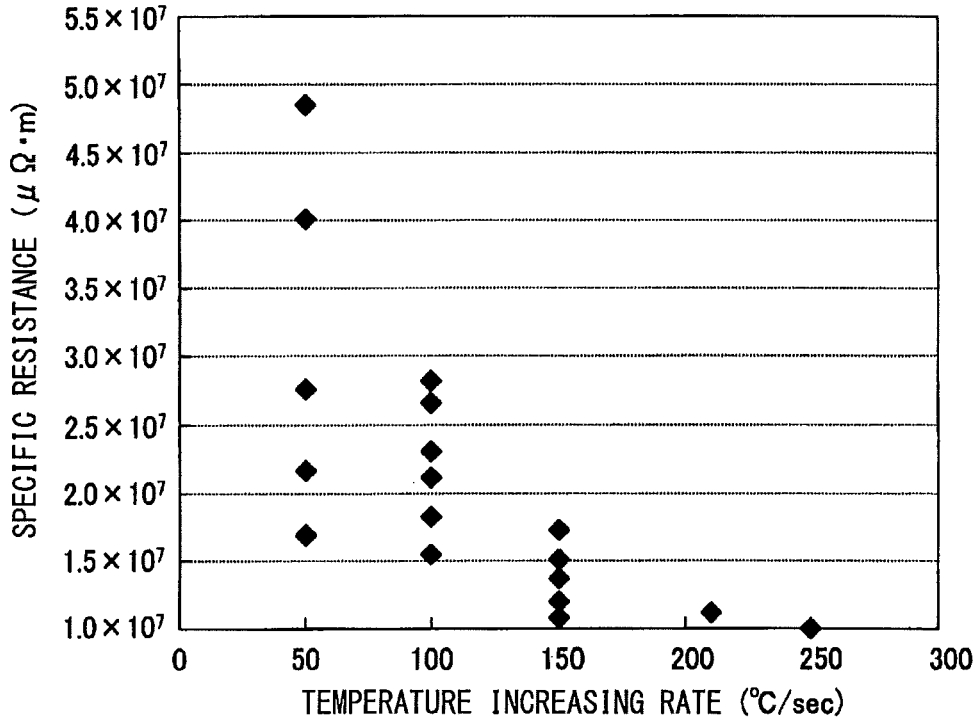
FIG. 2 is a graph showing a relationship between a temperature increasing rate and a specific resistance of a soft magnetic member.

As shown in FIG. 2, when the temperature increasing rate within the above-described heating temperature range is set to be 210° C./sec or lower in the process of forming the insulation layer, the specific resistance of the soft magnetic member can be improved. This is because a rapid temperature increase is avoided in the above-described temperature range, gas generated by thermal decomposition at heating and staying gas in the green compact pass to the outside more easily and inner pores due to remaining gas are reduced. Thus, the present case has an advantage for reducing the eddy loss of the soft magnetic member. An improving effect of the specific resistance increases with decrease of the temperature increasing rate. A lower limit of the temperature increasing rate can be selected appropriately while taking a productivity or the like into consideration.

Example 5

Multiple samples of soft magnetic member are formed in a manner similar to the example 1 except that the temperature increasing rate within a heating temperature range from the room temperature to 400° C. is 210° C./sec, the temperature increasing rate within a heating temperature range from the room temperature to 1000° C. is 210° C./sec, and the pressure in the heating atmosphere in the first induction heating is changed. Then, a specific resistance of each of the samples is measured, and a relationship between the pressure in the heating atmosphere within the heating temperature range from the room temperature to 400° C. and the specific resistance of the soft magnetic member is obtained.

Figure 3:
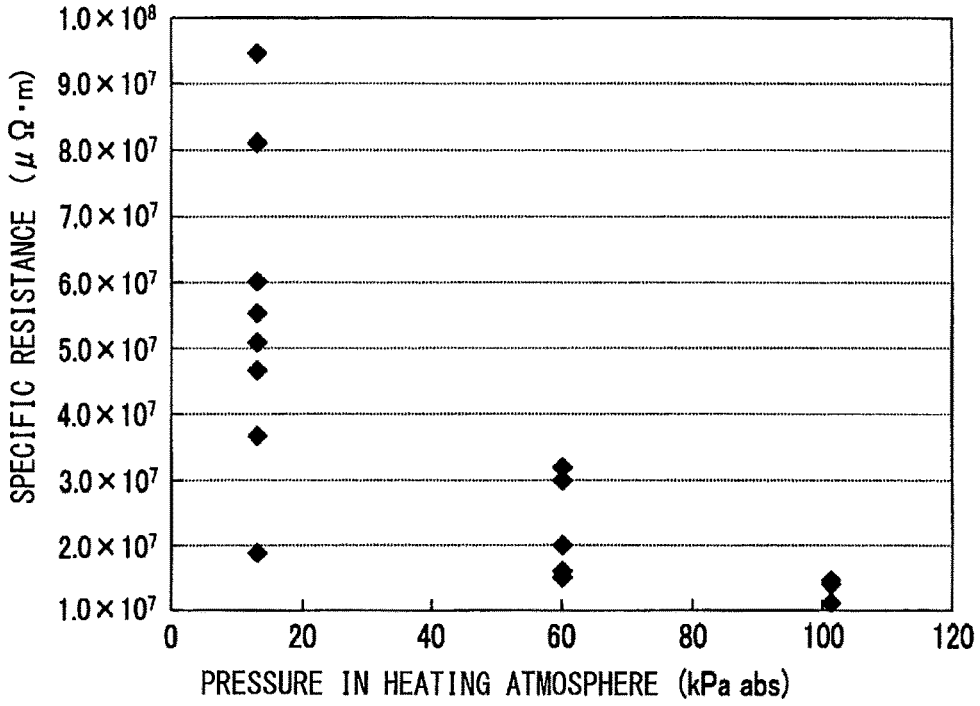
FIG. 3 is a graph showing a relationship between a pressure in a heating atmosphere and a specific resistance of a soft magnetic member.

As shown in FIG. 3, when the pressure in the heating atmosphere within the above-described temperature range is set to be atmospheric pressure or lower (100 kPa abs or lower), the specific resistance of the soft magnetic member can be improved. This is because, by reducing the pressure, gas generated by thermal decomposition at heating and staying gas in the green compact pass to the outside more easily, and inner pores due to remaining gas is reduced. Thus, the present case has an advantage for reducing the eddy loss of the soft magnetic member.

Example 6

In the example 1, the first induction heating is performed within the temperature range of 400° C. or lower. In the present example, multiple samples of soft magnetic member are formed in a manner similar to the example 1 except that a reaching temperature in the first induction heating is changed, the pressure in the heating atmosphere in the first induction heating is atmospheric pressure, the temperature increasing rate within the heating temperature range from the room temperature to the reaching temperature is 210° C./sec, the temperature increasing rate within the heating temperature range from the room temperature to 1000° C. is 210° C./sec. Then, a specific resistance of each of the samples is measured, and a relationship between a degassing temperature advantageously promoting degassing of gas generated by thermal decomposition at heating and staying gas in the green compact and the specific resistance of the soft magnetic member is obtained.

Figure 4:
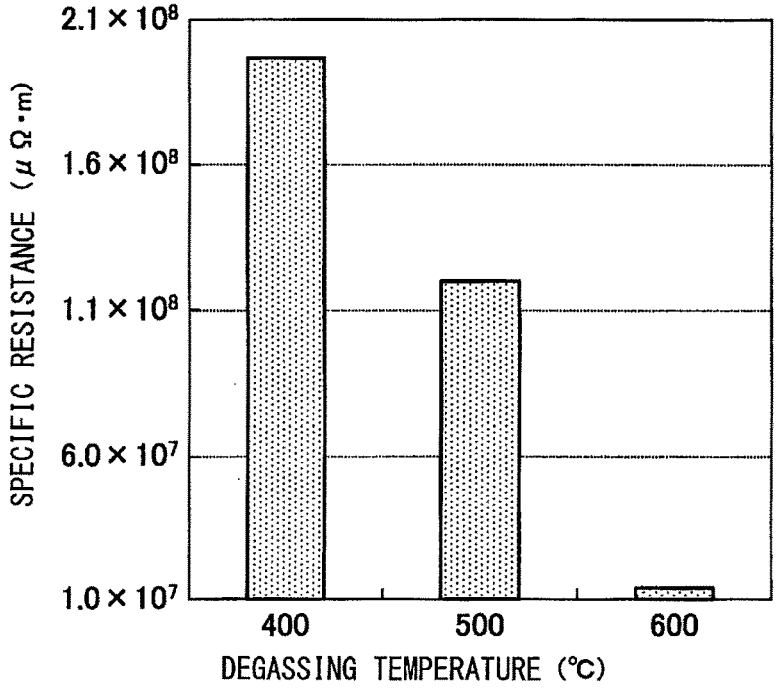
FIG. 4 is a graph showing a relationship between a degassing temperature and a specific resistance of a soft member.

As shown in FIG. 4, when the reaching temperature in the first induction heating is 500° C. or less, the specific resistance of the soft magnetic member can be easily improved. Thus, in the process of forming the insulation layer, it is effective for improving the specific resistance while reducing inner pores due to remaining gas that the temperature increasing rate is set to be 210° C./sec within the heating temperature range from the heating start temperature to 500° C. or lower, the pressure in the heating atmosphere is set to a decompression atmosphere equal to or lower than atmospheric pressure, or the green compact is maintained in the pressurized state. In addition, by combining the above-described settings, synergistic effects can be obtained.

While only the selected exemplary embodiments have been chosen to illustrate the present disclosure, it will be apparent to those skilled in the art from the present disclosure that various changes and modifications can be made therein without departing from the scope of the present disclosure as defined in the appended claims.

What is claimed is:

1. A manufacturing method of a soft magnetic member comprising:

preparing a material powder that includes ferrous particles and an organic layer formed on a surface of each of the ferrous particles, the organic layer containing at least one element selected from the group consisting of Si, Mg, Ti, and V;

compacting the material powder to form a green compact; and induction-heating the green compact with a frequency of 100 kHz or higher to form an insulation layer made of an oxide containing the element on the surface of each of the ferrous particles, wherein, after an induction heating is performed on a first induction heating condition from a heating start temperature to a heating middle temperature, an additional induction heating is performed to an oxidation temperature that enables oxidation of the element on a second induction heating condition, which is different from the first induction, without cooling the green compact, a temperature increasing rate as the second induction condition becomes higher than the temperature increasing rate as the first induction condition, and an atmosphere of the induction heating performed on the first induction heating condition and the additional induction heating performed on the second induction heating condition is air atmosphere.

2. The manufacturing method according to claim 1, wherein the element is Si, and the oxidation temperature is within a range from 800° C. to 1400° C.

3. The manufacturing method according to claim 1, wherein in the induction heating to form the insulation layer, the green compact is maintained in a pressurized state.

4. A manufacturing method of a soft magnetic member comprising:

preparing a material powder that includes ferrous particles and an organic layer formed on a surface of each of the ferrous particles, the organic layer containing at least one element selected from the group consisting of Si, Mg, Ti, and V;

compacting the material powder to form a green compact; and induction-heating the green compact with a frequency of 100 kHz or higher to form an insulation layer made of an oxide containing the element on the surface of each of the ferrous particles, wherein, after an induction heating is performed on a first induction heating condition from a heating start temperature to a heating middle temperature, an additional induction heating is performed to an oxidation temperature that enables oxidation of the element on a second induction heating condition, which is different from the first induction, without cooling the green compact, a temperature increasing rate as the second induction condition becomes higher than the temperature increasing rate as the first induction condition, and the temperature increasing rate in a heating temperature range of 500° C. or lower during the induction heating on the first induction heating condition is between 30° C./sec and 125° C./sec.

5. The manufacturing method according to claim 4, wherein in the induction heating performed on the first induction heating condition to form the insulation layer, a pressure in the heating temperature range of 500° C. or lower is atmospheric pressure or lower.

* * * * *